US005642547A

United States Patent [19]

Hutton et al.

[11] Patent Number: 5,642,547

[45] Date of Patent: Jul. 1, 1997

[54] BED SHEET ATTACHMENT DEVICE FOR A MATTRESS, AND METHOD

[76] Inventors: William B. Hutton; Deanice B. Hutton, both of 330 Riverside Dr., St. Helens, Oreg. 97051

[21] Appl. No.: 679,653

[22] Filed: Jul. 12, 1996

[51] Int. Cl.[6] ..... A47C 21/02

[52] U.S. Cl. ..... 5/692; 24/72.5

[58] Field of Search ..... 5/692, 496, 498, 5/504.1; 24/72.5; 112/475.08

[56] References Cited

U.S. PATENT DOCUMENTS

| | | | |
|---|---|---|---|
| 2,630,587 | 3/1953 | Brown | 5/692 |
| 3,179,958 | 4/1965 | Carris | 5/692 |
| 3,530,487 | 9/1970 | Beer | 5/496 |
| 4,488,323 | 12/1984 | Colburn | 5/692 |
| 4,660,240 | 4/1987 | Hutton et al. | 5/498 |
| 4,782,543 | 11/1988 | Hutton et al. | 5/498 |
| 4,862,541 | 9/1989 | Hutton et al. | 5/496 |
| 5,161,276 | 11/1992 | Hutton et al. | 5/692 |

*Primary Examiner*—Alexander Grosz
*Attorney, Agent, or Firm*—Smith-Hill and Bedell

[57] ABSTRACT

An attachment device for attaching an article of bedding to a mattress includes a generally flat gripper plate with a keyhole opening extending therethrough. A strip of elastic material attaches the gripper plate to the border of the mattress substantially halfway between the top and bottom surfaces of the mattress. A stud has head and base portions that are each too large to pass through the narrow region of the keyhole opening but at least the base portion is small enough to pass through the wide region of the keyhole opening. The stud has a neck portion that connects the base portion and the head portion and is narrow enough to enter the narrow region of the keyhole opening.

6 Claims, 2 Drawing Sheets

BED SHEET ATTACHMENT DEVICE FOR A MATTRESS, AND METHOD

BACKGROUND OF THE INVENTION

This invention relates to a device for attaching a bed sheet to a mattress.

For years, innerspring and foam mattresses were manufactured in twin, double, queen, and king sizes having fairly standard dimensions. In capturing the luxury market driven by demand for greater comfort and superior back support, mattresses that are higher or thicker than older conventional mattresses, some with additional quilted padding on the top and bottom, are being made available by manufacturers. While older conventional mattresses were approximately 7 inches thick, these newer mattresses can be up to 16 inches thick.

Bed clothing, particularly fitted sheets and mattress pads, designed to be used on the older conventional style of mattress, do not fit new, thicker mattresses. The corners of fitted sheets cannot fit over the bottom edges of thicker mattresses. Even flat sheets, if manufactured for use on the older mattresses, will seem skimpy when tucked under the edges of a new, thicker mattress. Neither an older fitted sheet nor an older flat sheet will remain properly in place on a new, thicker mattress. Therefore, when contemplating the purchase of a new mattress, it becomes necessary for the potential customer to consider the possibility that purchasing a new mattress will also require purchasing all new bed linens. This added cost could dissuade some people from purchasing a new-style mattress.

Alternatives to completely replacing the bedding designed specifically for previously-conventional mattresses have been suggested. U.S. Pat. No. 4,862,541 discloses a device for attaching a sheet to a mattress. The device comprises an elongate strap with a fastener at each end. The strap is positioned under the corner of a mattress with the two ends of the fastener projecting from beneath the mattress. The two fasteners are attached to adjacent edges of a sheet. U.S. Pat. Nos. 4,782,543 and 4,660,240 disclose devices for fastening sheets and bedding to water beds. These devices are not suited for use with conventional mattresses and must also be separately purchased and installed. U.S. Pat. No. 5,161,276, the disclosure of which is incorporated by reference herein, discloses a device that is included as an integral part of a new, thicker mattress for attaching a sheet to the mattress. This device is preferably installed by the manufacturer during manufacture of the mattress. The attachment device disclosed in U.S. Pat. No. 5,161,276 includes a grommet or other reinforcement structure defining an opening in the material forming the wall or border of the mattress, and protecting and reinforcing the material surrounding the opening, as a place for mounting the remainder of the attachment device. A pair of such grommets are installed in the wall of the mattress in the two sides that meet at a corner of the mattress. A rotatable coupler is connected to each grommet and holds one end of a rubber cord which is stretched between the two couplers, around the corner of the mattress.

SUMMARY OF THE INVENTION

In accordance with a first aspect of the invention there is provided a mattress having top and bottom surfaces and a peripheral border connecting the top and bottom surfaces, and an attachment device for attaching an article of bedding to the mattress, said attachment device comprising a gripper plate having a generally flat major portion with an opening extending therethrough, the opening having a first length region and a second length region, the first length region being between the second length region and an end of the major portion and being narrower than the second length region of the opening, a strip of elastic material attaching the gripper plate to the border of the mattress substantially halfway between the top and bottom surfaces of the mattress, and a stud having a base portion, a head portion and a neck portion connecting the base portion and the head portion, the head and base portions each being too large to pass through second region of the opening but at least the base portion being sized to pass through the first region of the opening and the neck portion being sufficiently narrow to enter the second region of the opening.

In accordance with a second aspect of the invention there is provided a method of manufacturing a mattress having top and bottom surfaces and a peripheral border that connects the top and bottom surfaces, said method comprising providing an attachment device including a gripper plate having a generally flat major portion with an opening extending therethrough, the opening having a first length region and a second length region, the first length region being between the second length region and an end of the major portion and being narrower than the second length region of the opening; a stud having a base portion, a head portion and a neck portion connecting the base portion and the head portion, the head and base portions each being too large to pass through second region of the opening but at least the base portion being sized to pass through the first region of the opening and the neck portion being sufficiently narrow to enter the second region of the opening; and a strip of elastic material attached to the gripper plate, and attaching the strip of elastic material to the border of the mattress substantially halfway between the top and bottom surfaces of the mattress.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
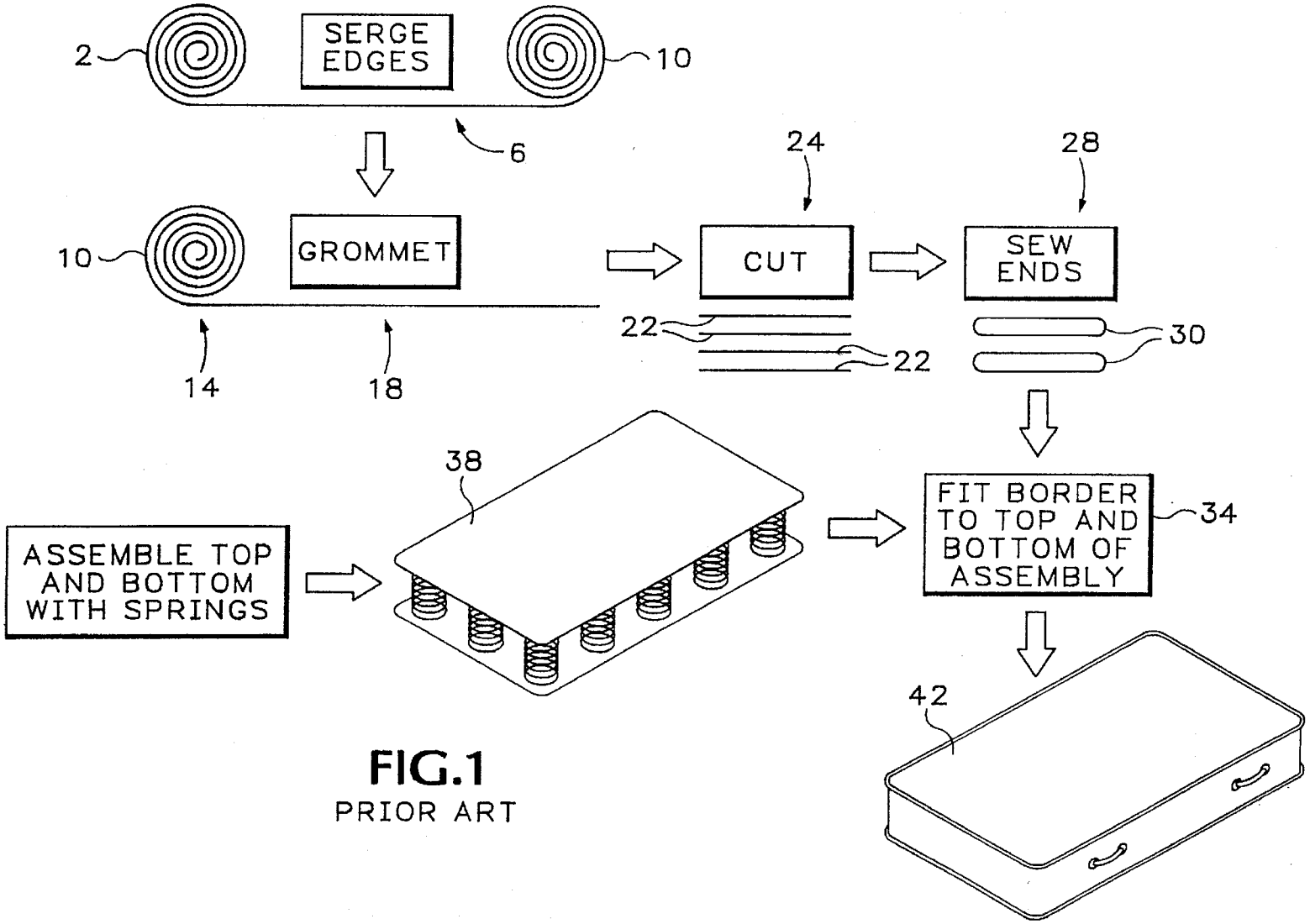
FIG.1 PRIOR ART
FIG. 1 is a partial schematic illustration of a production line for manufacture of mattresses.

Referring to FIG. 1, a strip of mattress border material is unwound from a storage roll 2 and passes to a first station 6 at which the edges of the strip are serged. This limits fraying of the strip of border material and the possibility of a loose thread being caught in the machinery used for subsequent processing of the border material. The serged border material is wound onto a roll 10. The roll 10 is delivered to an unwinding station 14, at which the border material is unwound and passed to a station 18 at which grommets for receiving mattress handles are installed in the strip. Each two pairs of grommets are spaced apart at a standard distance, typically about 3 feet, but the distance between one set of four grommets and a succeeding set of four grommets will depend on the size of the mattress that is to be fabricated from the particular length segment in which the grommets are installed.

The strip of border material is then cut into segments 22 at a station 24. The length of each segment depends upon the size of mattress that is to be made (twin, full, queen or king). If the strip of border material is to be used for king size mattresses, it is cut into segments that are approximately 320 inches long, whereas if the strip is to be used for queen, full or twin size mattresses, the segments are approximately 280, 260 and 230 inches long, respectively. It is, of course, possible to cut a given strip of border material into segments for a mixture of mattress sizes, in which case it is necessary to keep track of where each cut is to be made and to position the grommets accordingly.

The segments 22 of border material are delivered to a stitching station at which the two ends of each segment are stitched together to form an endless band 30. Further, at the stitching station 28 a back bar may be attached to the border material behind each pair of grommets. The band 30 is delivered to a further station 34, to which a sub-assembly 38 comprising the top and bottom of the mattress and the springs therebetween has been delivered. The endless border is fitted over the sub-assembly and is sewn to the top and bottom of the mattress, thus completing the mattress 42.

The method of manufacturing a mattress as described thus far is conventional. In accordance with the invention, gripper plates 46 (FIGS. 2 and 3) are attached to the border at the stitching station 28.

Figure 2:
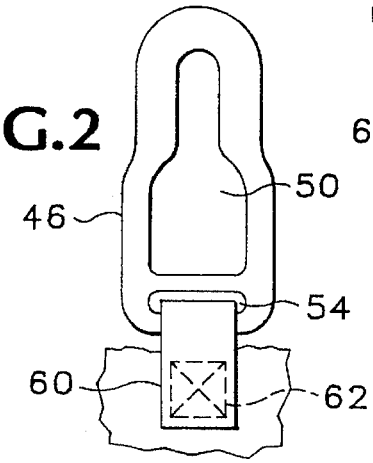
FIG. 2 is a front view of a gripper plate that forms part of an attachment device for a mattress in accordance with the present invention.
Figure 3:
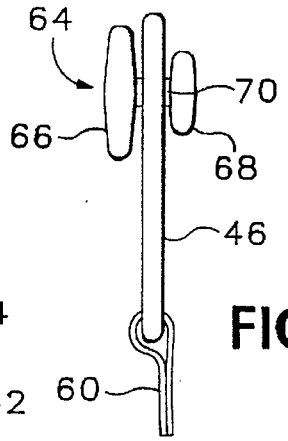
FIG. 3 is a side view of the gripper plate.
Figure 4:
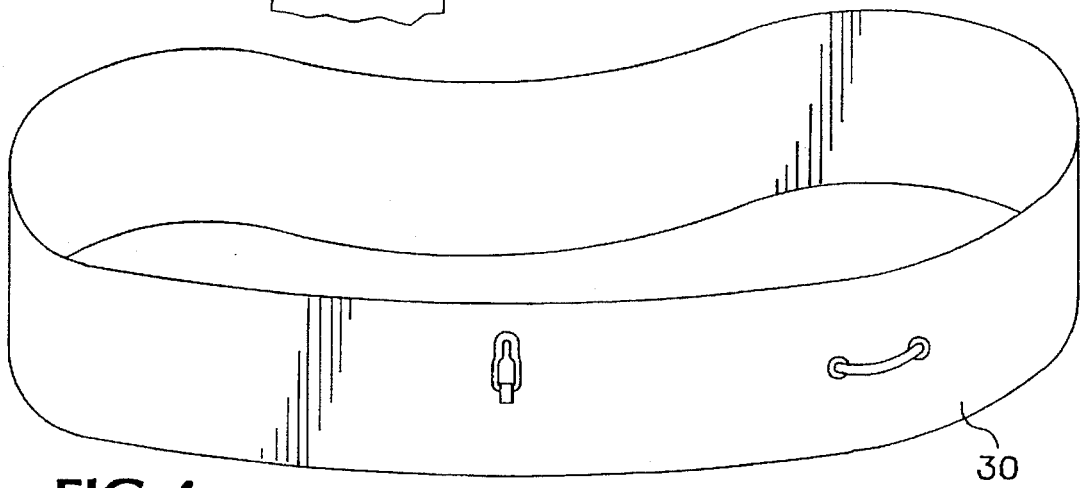
FIG. 4 is a perspective view of a mattress border to which an attachment device has been secured.

The gripper plate 46 may be made of a conveniently formed material such as a tough, rigid polymeric material. The plate has an upper end and a lower end, the words "upper" and "lower" referring to the orientation of the plate when the attachment device is in use, as shown in FIGS. 2 and 3. The plate is generally flat, having opposite sides which are generally parallel, and a thickness which is great enough to supply necessary strength and avoid sharp corners or edges which might tear the sheet, i.e. at least approximately 3/16 inch.

The gripper plate 46 defines an opening 50, which generally resembles a standard keyhole and has a wider portion near the lower end of the plate and a narrower portion near the upper end of the plate. The lower end of the gripper plate defines a second, slot-form opening 54 through which a strip 60 of elastic extends. The gripper plate 46 is attached to the strip of border material by stitching through the strip 60 of elastic material at the stitching station 28. The location of the stitching 62 is approximately halfway between the two edges of the endless band 30. Therefore, when the band is fitted over the sub-assembly 38 at the station 34, the location of the stitching 62 is approximately halfway between the top and bottom surfaces of the mattress.

Four gripper plates are secured to the band 30, at locations such that when the band is fitted over the sub-assembly 38, there will be one gripper plate at each of the four corners of the mattress.

Figure 5:
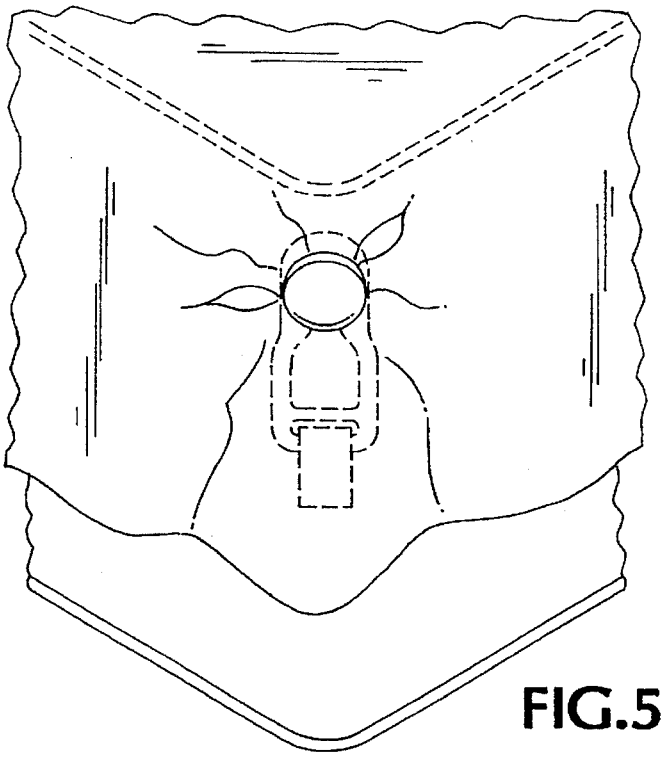
FIG. 5 is a perspective view from above one corner of a mattress equipped with a bed sheet attachment device embodying the present invention, together with a portion of an installed bed sheet held by the attachment device.

Each gripper plate is one component of an attachment device, which further comprises a stud 64 (FIG. 3), which includes a circular base portion 66 having a diameter greater than the width of the wider portion of the keyhole slot 50, a circular head portion 68 having a diameter intermediate between the width of the narrower portion of the keyhole slot 50 and the width of the wider portion of the keyhole slot 50, and an interconnecting neck portion 70 whose diameter is slightly smaller than the width of the narrower portion of the keyhole slot. Since the diameter of the head portion is smaller than the width of the wider portion of the keyhole slot, and because the width of the keyhole slot is greater than the diameter of the neck, the stud may be fitted into the slot in the plate member with portions of a sheet or other article of bedding extending around the head and neck, as shown and described in U.S. Pat. No. 5,161,276. Sufficient clearance is provided between the neck and the interior of the keyhole slot to receive the sheet and hold it securely when the neck of the stud is located within the keyhole slot near the upper end thereof. The head of the stud is shaped to avoid unnecessarily stressing a sheet held by the attachment device. Thus, the attachment device is used in the manner described in U.S. Pat. No. 5,161,276 for attaching an article of bedding, such as a sheet, to the mattress, as shown in FIG. 5.

The attachment device described above is advantageous because the gripper plate is attached to the mattress by the elastic strap and therefore the possibility that the gripper plate will be misplaced is reduced. Further, there is no need to remove and reinstall the gripper plate when the mattress is turned, because the height of the gripper plate relative to the top surface of the mattress does not change when the mattress is turned, because the strap is attached to the border approximately halfway between the two main surfaces of the mattress.

It will be appreciated that the invention is not restricted to the particular embodiment that has been described, and that variations may be made therein without departing from the scope of the invention as defined in the appended claims and equivalents thereof.

We claim:

1. A mattress having top and bottom surfaces and a peripheral border connecting the top and bottom surfaces, and an attachment device for attaching an article of bedding to the mattress, said attachment device comprising:

a gripper plate having a generally flat major portion with a first opening extending therethrough, the opening having a first length region and a second length region, the first length region being between the second length region and an end of the major portion and being narrower than the second length region, of the opening, a strip of elastic material attaching the gripper plate to the border of the mattress substantially halfway between the top and bottom surfaces of the mattress, and a stud having a base portion, a head portion and a neck portion connecting the base portion and the head portion, the head and base portions each being too large to pass through second region of the opening but at least the base portion being sized to pass through the first region of the opening and the neck portion being sufficiently narrow to enter the second region of the opening.

2. A mattress according to claim 1, wherein the strip of elastic material is attached to the border of the mattress by stitching.

3. A mattress according to claim 1, wherein the gripper plate is formed with a slot-form opening positioned such that the second length region of the first opening is between the first length region of the first opening and the slot-form opening, and the strip of elastic material passes through the slot-form opening and is attached to the border of the mattress by stitching.

4. A method of manufacturing a mattress having top and bottom surfaces and a peripheral border that connects the top and bottom surfaces, said method comprising:

providing an attachment device including a gripper plate having a generally flat major portion with an opening extending therethrough, the opening having a first length region and a second length region, the first length region being between the second length region and an end of the major portion and being narrower than the second length region of the opening; a stud having a base portion, a head portion and a neck portion connecting the base portion and the head portion, the head and base portions each being too large to pass through second region of the opening but at least the base portion being sized to pass through the first region of the opening and the neck portion being sufficiently narrow to enter the second region of the opening; and a strip of elastic material attached to the gripper plate, and attaching the strip of elastic material to the border of the mattress substantially halfway between the top and bottom surfaces of the mattress.

5. A method according to claim 4, comprising providing a web of border material, cutting a segment of border material from the web, and delivering the segment of border material to a stitching station, and wherein the ends of the segment are stitched together at the stitching station to form the peripheral border and the strip of elastic material is attached to the border by stitching at the stitching station.

6. A method according to claim 4, comprising attaching the strip of elastic material to the border of the mattress by stitching.

* * * * *